US006017214A

United States Patent [19]

Sturgulewski

[11] Patent Number: 6,017,214

[45] Date of Patent: Jan. 25, 2000

[54] INTERLOCKING FLOOR BRICK FOR NON-RECOVERY COKE OVEN

[75] Inventor: Raymond M. Sturgulewski, Pittsburgh, Pa.

[73] Assignee: Pennsylvania Coke Technology, Inc., Greensburg, Pa.

[21] Appl. No.: 09/166,711

[22] Filed: Oct. 5, 1998

[51] Int. Cl.[7] ..... F27D 1/04

[52] U.S. Cl. ..... 432/247; 432/238; 202/102; 202/212

[58] Field of Search ..... 432/192, 238, 432/247, 248; 110/322, 323; 202/102, 212

[56] References Cited

U.S. PATENT DOCUMENTS 3,936,987 2/1976 Calvin .
4,111,757 9/1978 Ciarimboli ..... 202/102
4,287,024 9/1981 Thompson ..... 202/134
4,297,816 11/1981 Kella et al. .
4,299,666 11/1981 Ostmann ..... 202/139
4,344,820 8/1982 Thompson ..... 201/15
5,104,314 4/1992 Amore ..... 432/239
5,117,604 6/1992 Bly et al. .
5,676,540 10/1997 Williams et al. .

*Primary Examiner*—John A. Jeffery
*Assistant Examiner*—Gregory A. Wilson
*Attorney, Agent, or Firm*—Armstrong, Westerman, Hattori, McLeland & Naughton

[57] ABSTRACT

An improved non-recovery coke oven floor constructed of a single layer of refractory bricks including, for each oven sole flue, a pair of trunnion bricks and a center bridge brick spanning the width of the flue, having lower brick surfaces in the form of an arch, and joined end-to-end by a tapered tongue-and-groove joint disposed approximately perpendicular to the direction of a compression load transmitted by the center bridge brick to the trunnion bricks.

12 Claims, 4 Drawing Sheets

INTERLOCKING FLOOR BRICK FOR NON-RECOVERY COKE OVEN

BACKGROUND

1. Field of the Invention

This invention relates to improved floor structures for non-recovery coke ovens (coke ovens in which evolved gases and volatiles are not recovered but, rather, are burned) and, more particularly, to a floor structure comprising a single layer of specially designed brick, preferably three in number, comprising two end trunnion bricks and a center bridge brick, each with interlocking joints, and wherein the bricks have a flat top surface and a curved surface on the lower surface of the center bridge brick and on a part of the lower surface of each of the trunnion bricks and forming a load-supporting arch.

2. Description of the Prior Art

Two designs of coke oven floor construction currently are used in this industry. Each comprises a composite floor made of multiple elements.

One such prior art construction, shown in FIG. 2, uses a composite of three elements for each coke oven sole flue and including (1) a row of bricks having the collective lower surfaces thereof in the form of an arch and fixed in place by two end skew back bricks, (2) a dense castable refractory material filling in the valleys of the low points of the arches and (3) a flat floor of flat bricks laid on top of the castable refractory.

The other, less complicated, such prior art construction is shown in FIG. 3 and comprises two floor elements for each sole flue, (1) an arch and skew back brick arrangement as used in the first design and (2) specially shaped bricks conforming, on their lower surfaces to the top of the arch and, on their top surfaces, presenting a flat floor construction.

Such prior art coke oven floor designs have three major disavantages. First, they are inherently thick, adding weight (and cost) to the floor; second, each refractory component element has its own expansion characteristics, with the result that, during heat-up of the oven, gaps will form between each different component and act as a dead air space retarding heat transfer, and third, the use of multiple components, each with its own heat conductivity characteristics, creates a lack of homogeneous construction that defies proper thermal modeling and complicates floor installation.

Interlocking brick also are known to the prior art. For example, U.S. Pat. Nos. 3,936,987 and 4,297,816 show interlocking bricks for building construction and having grooves and interlocking pins. For the same purpose, U.S. Pat. No. 5,117,674 discloses a ring and groove interlocking brick construction. The use of a tongue and groove design is known in many fields of the prior art, for example, U.S. Pat. No. 5,676,540 relates to the construction of flue walls of a ring furnace with bricks having a tongue and groove design.

SUMMARY OF THE INVENTION

This invention provides a non-recovery coke oven floor which substantially avoids the disadvantages of current prior art designs. The improved floor construction of this invention comprises, for each sole flue of the coke oven, three bricks—two trunnion bricks and a center bridge brick juxtaposed end-to-end and joined by an interlocking tongue and groove joint extending from an upper to a lower surface of each brick and at an angle to the vertical so better to resist breakage when the vertical loading forces applied to the floor bricks by a coal charge are transformed into substantially horizontal compression forces thereby diminishing the effect of local tension forces common in a simple beam structure. Such effect of the new floor construction is facilitated by forming a lower surface of the center bridge brick and an adjacent portion of each trunnion brick into a shallow arch form.

DESCRIPTION OF PREFERRED EMBODIMENTS

A non-recovery coke oven is a large refractory structure constructed of silica brick. It is used to convert coal into blast furnace grade coke by heating the coal in a reducing atmosphere and operating under negative pressure.

Figure 1:
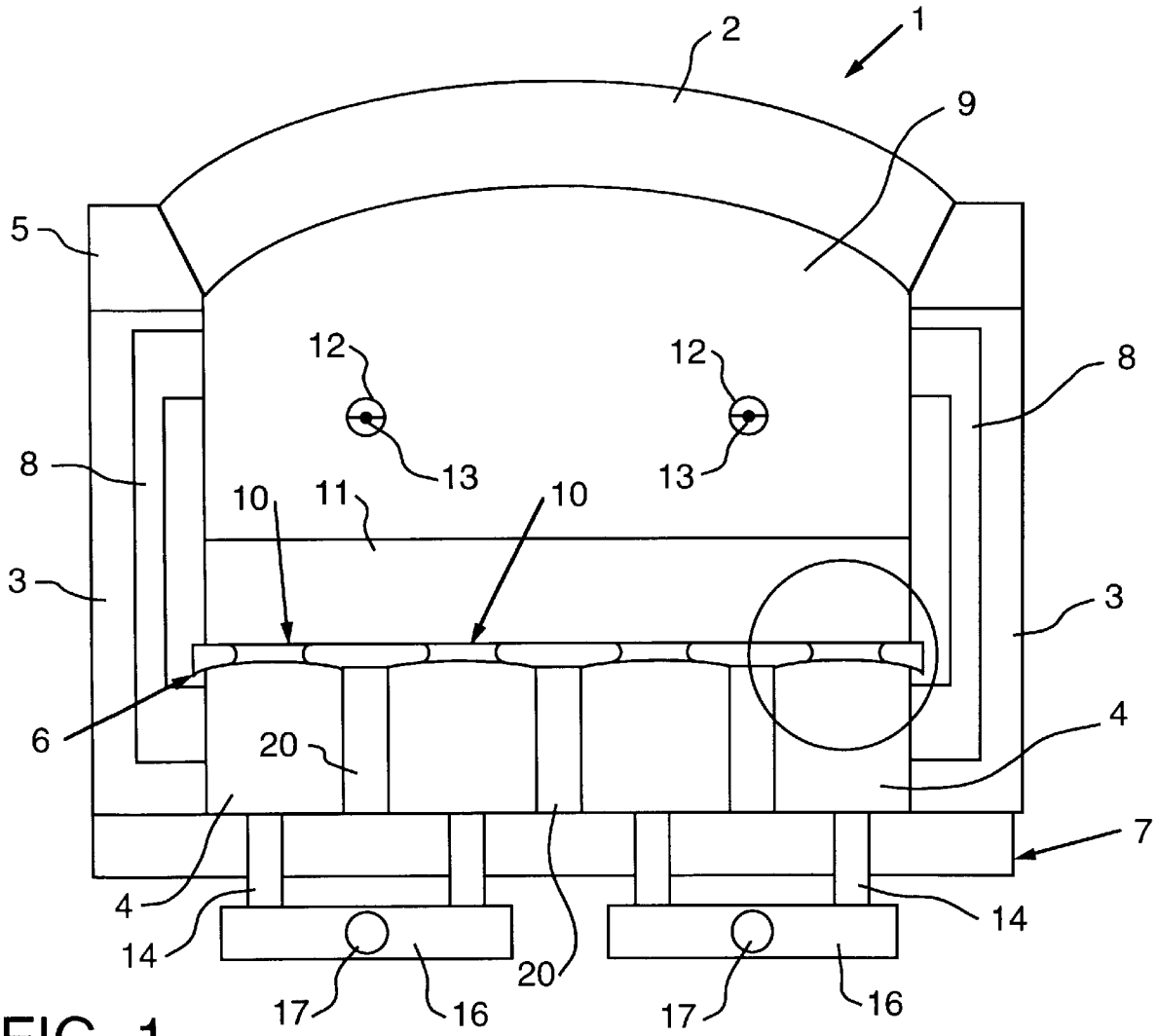
FIG. 1 is a cross-sectional end elevational view of a non-recovery coke oven showing, in generalized form, the improved floor of this invention, and otherwise conforming to known prior art oven design.

FIG. 1 shows a non-recovery coke oven, denoted generally by the numeral 1, of the prior art type except for the use of the improved floor of this invention. The oven 1 comprises an arched roof 2, two side walls 3, sole flues 4 located beneath a floor, denoted generally by the numeral 6, and a refractory and steel sub-structure, denoted generally by the numeral 7, for support, and including upright floor supports 20 defining, with the oven sidewalls, and in the case of the side flues 4, the sole flue space for burning gases and volatiles. Skew back structures 5 are disposed between the inclined end of the roof arch and the sidewalls of the oven to support the roof 2 and to transmit its load to the sidewalls 3. Ends of the oven are enclosed by removable doors. Within the walls 3 are passages called "downcomers" 8 which transfer gases and volatiles from a free space 9 above a coal bed 11 to a plurality (four shown in FIG. 1) of the sole flues 4. Primary air is introduced into the free space 9 through inlets 12 having dampers 13 therein to control the amount of primary air so introduced. Secondary air is introduced into the sole flues 4 through secondary air inlets 14 connected to manifolds 16 each of which in turn is connected to a source of air 17.

As also shown in FIG. 1, the oven floor 6, in accordance with this invention, comprises a plurality of segments, each denoted generally by the numeral 10, corresponding in number to the number of sole flues 4 and wherein each segment 10 forms a part of the oven floor 6 over a corresponding sole flue.

In operation, the oven is heated by external means, e.g. an air/fuel burner, to about 2500° F., the external heat then is shut off and a charge of coal, forming coal bed 11, is inserted into the oven through the removable doors. The surface of the coal bed immediately generates combustible gases and volatiles by the radiant energy absorbed from the oven refractories, primarily the roof 2. Approximately ⅓ of the gas and volatiles are selectively burned by drawing primary air into the oven past dampers 13 and through inlets 12. The combustion products and the remaining ⅔'s of the combustibles are drawn through the downcomers 8 into the sole flues 4 where secondary air is drawn into the sole flues through inlets 14 to burn the remaining combustibles. The heat generated by the primary combustion in the free space 9 and the secondary combustion in the sole flues 4 provides the heat necessary to convert the coal into coke.

The proportion of primary and secondary air also controls the rate at which the thermal energy proceeds through the coal bed 11. Two independent thermal gradients occur, one beginning at the top of the coal bed and progressing downward, and one beginning at the oven floor and progressing upward (the sole flue gradient).

The speed of heat transfer, under the influence of the sole flue thermal gradient, through the coal is dependent upon the temperature of the upper surface of the silica floor which, in turn, depends upon the temperature of the gas in the sole flue and the floor thickness and the thermal conductivity of the brick.

Figure 2:
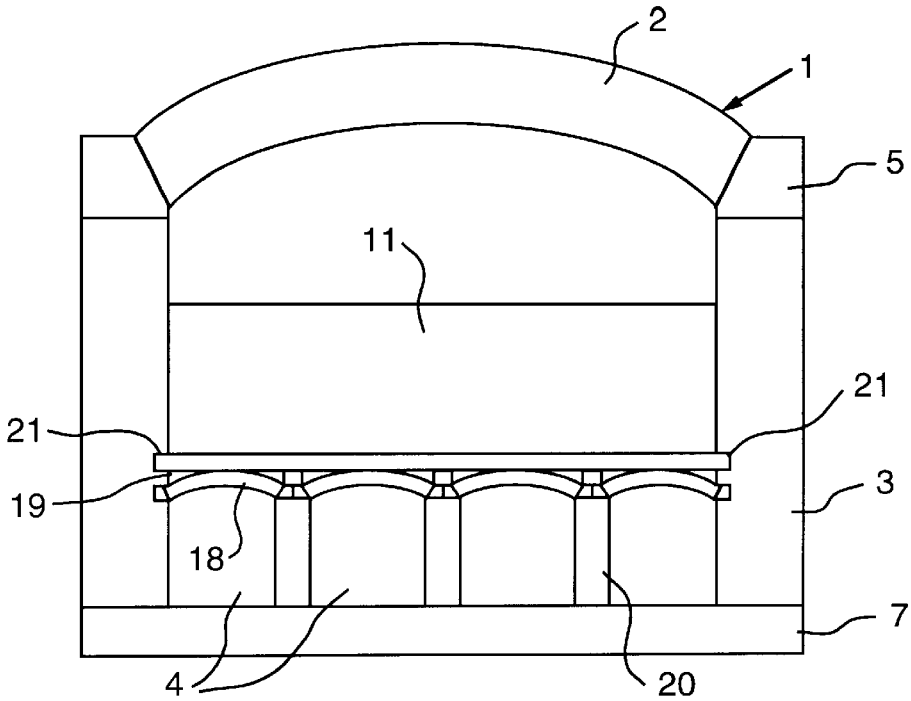
FIG. 2 Prior Art
FIG. 2 is a similar view of a prior art non-recovery coke oven having one type of prior art floor.

In FIG. 2 the composite coke oven floor, made up of arch bricks 18, dense castable 19, and a flat brick floor plate 21, has the inherent disadvantages enumerated in the above description of the prior art. Similarly, the composite oven floor shown in the prior art design of FIG. 3, using a system of arch bricks 22 and specially shaped "filler" bricks 23, has similar disavantages, as above described.

Figure 4:
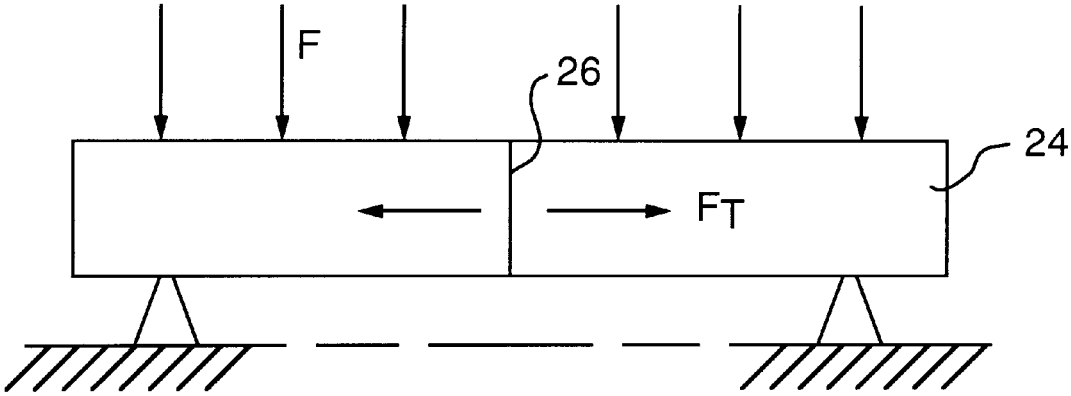
FIG. 4 is a sketch, in side elevation, of a simple beam structure supported at each end showing vertical loading forces applied to the top of the beam and the conversion of those forces into tension forces in the beam itself.
Figure 5:
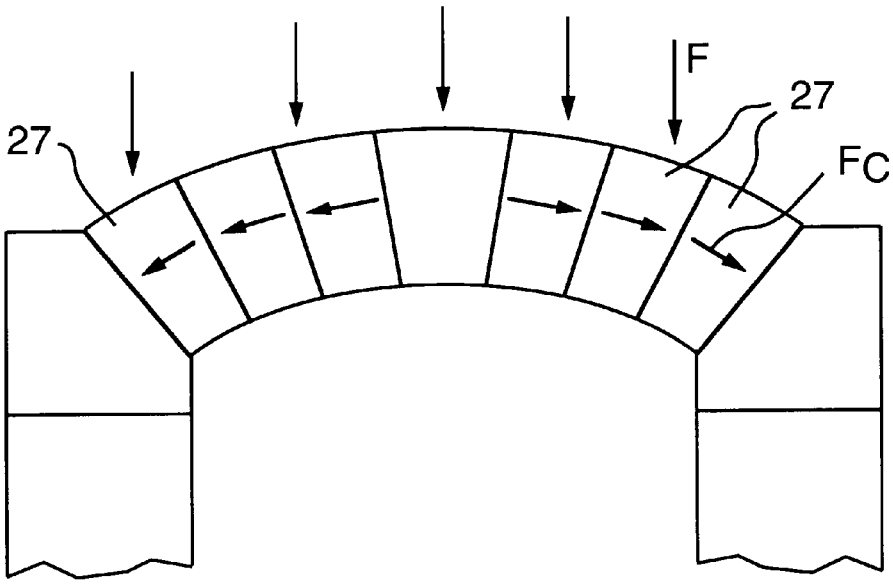
FIG. 5 is a similar sketch, showing similar loading forces applied to the top of an arched floor construction and the conversion of those forces into compressive forces within the floor bricks.

The value of an arch form of the floor is seen from FIGS. 4 and 5. In FIG. 4 a simple beam 24, e.g. of brick, is supported at the ends and is loaded with a vertical force F which is transformed inside the beam to essentially horizontal tension forces $F_T$ which, in view of the low tensile resistance of the brick, tend to rupture the beam along the center at line 26. On the other hand, FIG. 5 shows an arched construction made up of tapered bricks 27 which transform the vertically-applied force F into substantially horizontally-directed compression forces $F_c$ which the brick is adapted to bear because of its high compressive strength.

Figure 6:
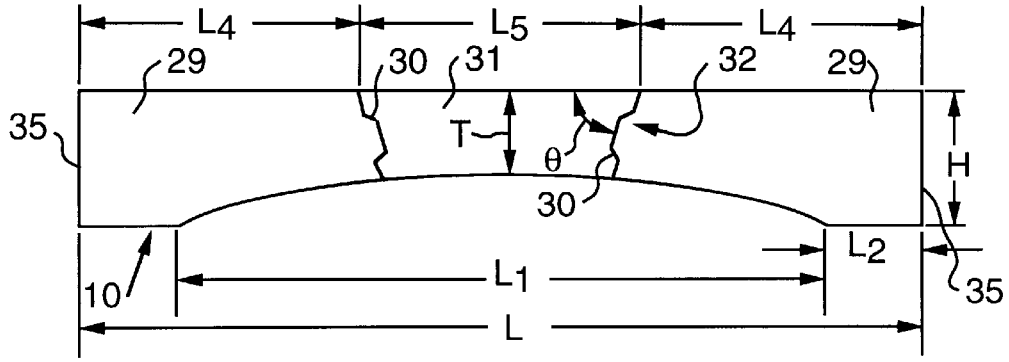
FIG. 6 is a side elevational view of a preferred form of floor construction according to this invention.

As seen in FIG. 6, an enlargement of the floor section circled in FIG. 1, each segment 10 of the improved coke oven floor 6, comprises three elements—a pair of trunnion bricks 29 and a center bridge brick 31. These bricks are joined end-to-end by a tongue and groove joint 32 set at an angle Θ so that the tongue and groove joint is substantially perpendicular to the direction of the compressive loads transmitted by the center brick 31 to the trunnion bricks 29. The complement of the angle Θ suitably is about 10–30°, e.g. about 15°, from the vertical. The tongue and the groove of each joint 32 preferably is tapered, at 30, to reduce the likelihood of the joint's breaking under load as compared to a 90° tongue and groove. The center brick 31, and inner portions of the trunnion bricks 29 are curved in the form of an arch to simulate the arch construction of prior art coke oven floors without the disadvantages thereof. Thus the new design closely approaches a multiple brick arch of the prior art in converting top-applied vertical loads to horizontal compression loads to which the bricks are resistant, as compared to a simple beam—as illustrated in FIGS. 4 and 5 and discussed above.

It is preferred to maintain a maximum trunnion brick height H of 6 inches and a flat base L2 of 4½ inches, with a minimum thickness T of 4 inches in the center of the arch (about the same thickness as that of the sidewall brick), e.g. the same dimensions as those of standard silica brick used to construct non-recovery coke ovens and having a height of 6 inches and a flat base of 4½ inches. The overall length L of each segment 10 is such as to span the flue width L1 measured by the distance between the floor supports 20, or, in the case of the segments 10 nearest the side walls 3, between the corresponding side wall and an adjacent support 20, to form a part of the floor 6 over each sole flue, plus a length L2 on one end of each trunnion brick for support on a floor support 10 or a sidewall 3, as the case may be. Thus, the length L is fixed by the coke oven sole flue size. Once this dimension is fixed, the arch radius to provide the necessary mid-arch thickness across the length L1 is fixed. An object of the invention is to reduce the number of bricks as compared to prior art arched floor construction, but to avoid such large bricks that they cannot be easily manually handled. Thus the use of three bricks per segment was selected. Selection of this number of bricks per segment is further determined to avoid failure, under vertical load, of a floor segment 10 at the thinnest part of the arch. The use of three segment elements places the thinnest part of the arch at the middle of the center bridge brick 31, well away from an end-to-end joint 32. Illustratively, for an approximately 30 inches wide sole flue, the lengths L4 of the trunnion bricks 29 may be about 12¾ inches and the length L5 of the center bridge brick may be about 13 inches.

Figure 3:
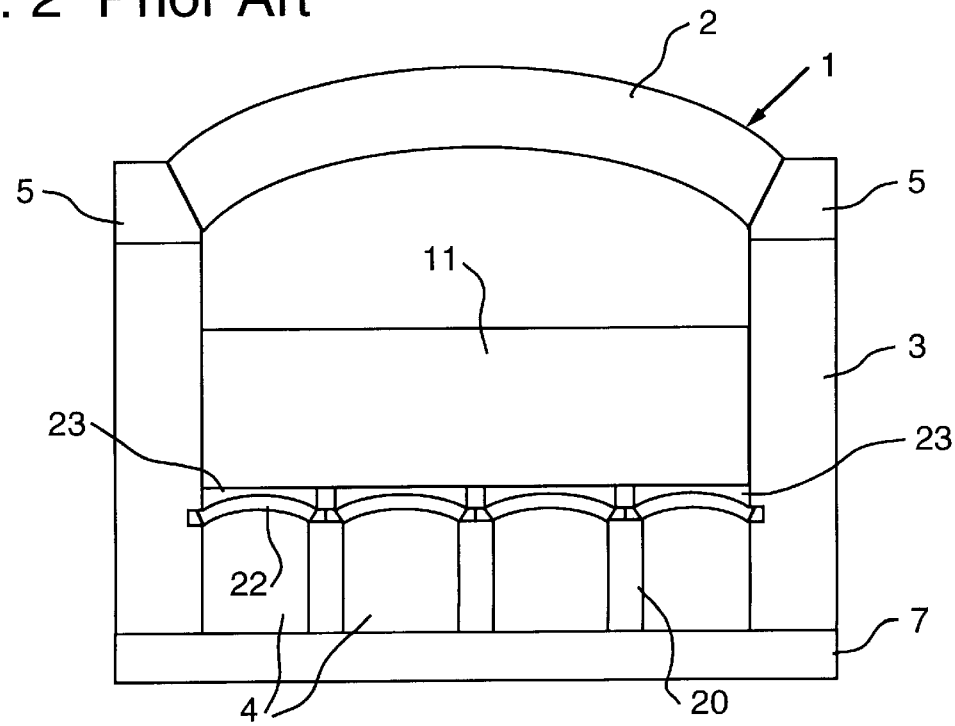
FIG. 3 Prior Art
FIG. 3 is a similar view of a prior art non-recovery coke oven having another type of prior art floor.
Figure 7A:
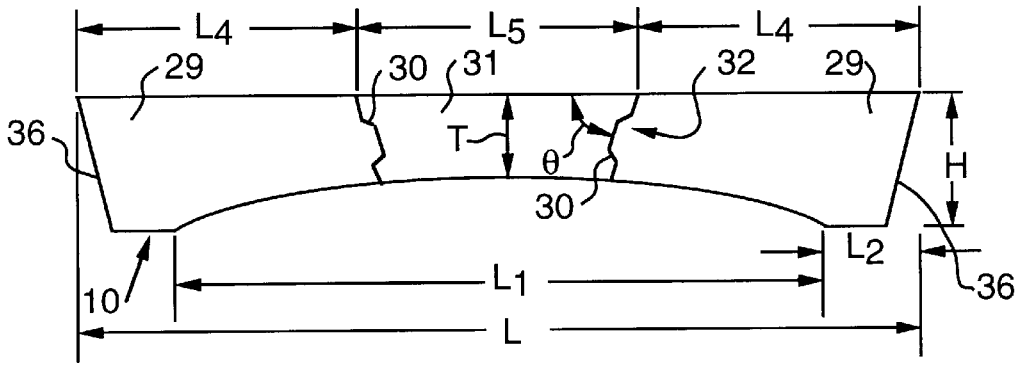
FIG. 7A is a view, similar to that of FIG. 6, of another form of the improved floor construction of this invention.
Figure 7B:
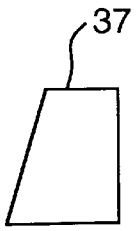
FIG. 7B is a side elevation of a skew brick used in conjunction with the embodiment of the floor construction shown in FIG. 7A.

As also shown in FIG. 6, in contrast to the prior art floor constructions as shown in FIGS. 2 and 3, the trunnion bricks 29 preferably have straight vertical ends 35 for mounting in the sidewalls 3 or on the floor supports 20 in order to effectively lock those bricks into the sidewalls 3 and minimize the tendency of the trunnion bricks to pop out of place due to thermal expansion on heating. With such construction, the need for extra skewback bricks, as in the prior art, is eliminated. Nevertheless, the trunnion bricks 29 may reasonably safely have tapered ends 36, as shown in FIG. 7A, in which case those ends 36 may butt against a skewback brick 37 mounted in the sidewalls 3 or on the floor supports 20, as shown in FIGS. 2 and 3.

Thus it is seen that this invention provides an interlocking non-recovery coke oven brick floor which can simulate the load-resisting characteristics of the prior arched brick floor design, but using fewer bricks in a thinner, single layer floor which reduces weight and increases heat transfer from the sole flues 4 to the coal bed 11, thereby significantly contributing to the operating efficiency of the coke oven as well as reducing installation costs.

What is claimed is:

1. An improved non-recovery coke oven single layer refractory floor which, as compared to the prior art, has a substantially undiminished load carrying capacity with reduced floor weight and increased transfer of heat from sole flues under the floor to a coal charge disposed on top of the floor, said floor comprising a number of floor segments equal to the number of sole flues in the oven, wherein each floor segment comprises a pair of trunnion bricks and a center bridge brick disposed in end-to-end relationship and together spanning a width of a corresponding sole flue, and wherein said upper surfaces of said floor segments have a flat top and wherein lower surfaces of the center bridge brick and of an adjacent portion of each trunnion brick are curved to form an arch spanning a width of a corresponding sole flue and adapted to transform a vertically directed tension force applied to said flat top of the segment to a substantially horizontally directed compressive force.

2. A coke oven floor according to claim 1, further comprising a plurality of floor supports adapted to support a free end portion of a trunnion brick and wherein another free end portion of the trunnion brick is supported by another floor support or by a coke oven sidewall.

3. A coke oven floor according to claim 2, further comprising a tongue-and-groove joint joining together adjacent ends of the trunnion bricks and the center bridge brick of each floor segment.

4. A coke oven floor according to claim 3, wherein each tongue-and-groove joint is disposed at an angle to the vertical.

5. A coke oven floor according to claim 4, wherein the tongue-and-groove joint is disposed substantially perpendicular to a direction of a compressive force transmitted by the center bridge brick to the trunnion bricks.

6. A coke oven floor according to claim 5, wherein the tongue-and-groove joint is disposed at an angle from about 10 to 30° from the vertical.

7. A coke oven floor according to claim 6, wherein the tongue-and-groove joint is disposed at an angle of about 15° from the vertical.

8. A coke oven floor according to claim 2, wherein the free end portions of the trunnion bricks have a standard coke oven brick height of about 6 inches and a standard flat base length of about 4½ inches for mounting on a corresponding floor support or coke oven sidewall.

9. A coke oven floor according to claim 8, wherein a thinnest center part of the center bridge brick has a minimum thickness of about 4 inches.

10. A coke oven floor according to claim 2, wherein free end surfaces of the trunnion bricks are flat vertical surfaces adapted to lock into a furnace sidewall or floor support without the use of skewback bricks.

11. A coke oven floor according to claim 2, further comprising skewback bricks mounted in the coke oven sidewalls and on the floor supports, and wherein free end surfaces of the trunnion bricks are in the form of a flat tapered surface adapted to abutt and be held in place by the skewback bricks.

12. An improved non-recovery coke oven floor comprising a single layer of refractory bricks having an upper surface and a lower surface, the refractory bricks comprising, for each sole flue, a pair of trunnion bricks and a center bridge brick spanning the width of the flue, and wherein said upper surfaces of said floor bricks have a flat top and wherein said lower surfaces or said bricks are in the form of an arch, and joined end-to-end by a tapered tongue-and-groove joint disposed approximately perpendicular to the direction of a compression load transmitted by the center bridge brick to the trunnion bricks.

* * * * *